United States Patent [19]

Clarke

[11] 4,077,625

[45] Mar. 7, 1978

[54] PNEUMATIC CUSHION TOY

[76] Inventor: William A. Clarke, 1001 Linden Ave., Erie, Pa. 16505

[21] Appl. No.: 669,316

[22] Filed: Mar. 22, 1976

[51] Int. Cl.[2] ..... A63B 21/28

[52] U.S. Cl. ..... 272/116; 272/1 R; 272/142; 273/1 R; 273/DIG. 19

[58] Field of Search ..... 272/93, 116, 1 R, 1 B, 272/77, 114, 115, 116, 119, 130, 135, 136, 137, 139, 143, 900, 109, 125, 126, 127, 134; 273/58 C, 58 B, 58 BA, 58 D, 58 E, 58 K, 58 R, 1 R, DIG. 19; 9/2 A, 11 A

[56] References Cited

U.S. PATENT DOCUMENTS

| | | | |
|---|---|---|---|
| 2,173,963 | 9/1939 | Eubank | 9/11 A |
| 2,665,519 | 1/1954 | Burkes | 272/1 B X |
| 2,718,644 | 9/1955 | Barr | 273/58 K X |
| 2,938,727 | 5/1960 | Nosak | 272/115 |
| 3,069,162 | 12/1962 | Samuel | 272/1 B X |

FOREIGN PATENT DOCUMENTS

| | | | |
|---|---|---|---|
| 117,095 | 3/1930 | Australia | 273/58 D |
| 972,485 | 8/1950 | France | 272/77 |

*Primary Examiner*—William H. Grieb
*Assistant Examiner*—Arnold W. Kramer
*Attorney, Agent, or Firm*—Ralph Hammar

[57] ABSTRACT

Pneumatic cushion childrens' toy in which two children are respectively confined between a sling and opposite sides of a huge pneumatic cushion attached to the center of the sling. By reason of the cushion, the children can dance about and push or pull or bump each other without direct bodily contact.

2 Claims, 4 Drawing Figures

PNEUMATIC CUSHION TOY

This invention is a childrens' toy in which two children are fastened to opposite sides of a huge cushion which prevents direct bodily contact as the children dance about or push or pull or bump each other. The cushion also provides support in case one or both of the children should stumble. In a preferred form the sling and the cushion is made of flexible air impervious material such as rubberized fabric, vinyl plastic, etc. and is in the form of a ball.

Figure 1:
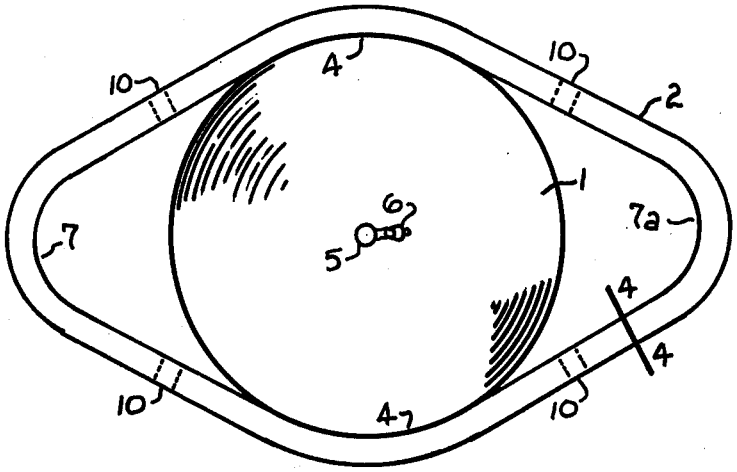
FIG. 1 is a top plan view of the toy.
Figure 2:
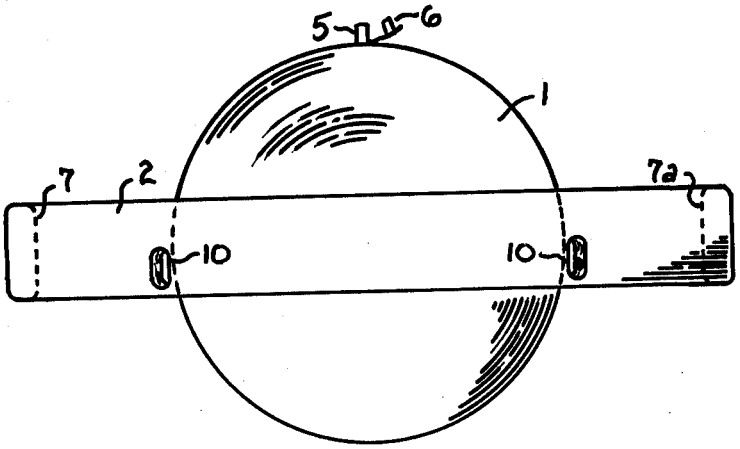
FIG. 2 is a side elevation.
Figure 3:
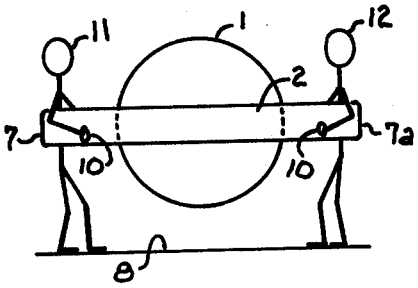
FIG. 3 is a stick figure showing the relation of the players to the toy.
Figure 4:
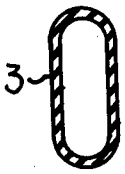
FIG. 4 is a section on line 4—4 of FIG. 1.

In the drawing 1 indicates an inflatable pneumatic cushion in the form of a ball. The shape of the cushion is not critical. The normal bulging or ballooning of the cushion walls under the inflation pressure would cause the walls to bulge outward toward a spherical or semi-spherical shape. From a manufacturing standpoint it may be simpler to make the cushion from flat walls seamed together rather than the spherical walls illustrated. Surrounding and fastened to the cushion at its midsection a horizontal sling 2 straddling the cushion and in the form of an endless hollow flattened tube 3 as shown in FIG. 4. The material of the sling is preferably the same as the material of the cushion. It is also preferable that in at least one of the zones 4 of contact between the sling 2 and the cushion 1 there be communication between the cushion and the sling so that both may be inflated at the same time and both may be subject to the same hydrostatic air pressure. The inflation may be in any convenient manner such as through the nozzle 5 and stopper 6 at the top center of the cushion 1. Since high air pressure is not required the cushion and sling may be inflated by mouth. The end loops 7, *7a* are spaced from the adjacent surfaces of the cushion to allow the players to step into the space between the loops 7, *7a* and the cushion and to lift the sling and cushion to a position centered around the waists of the players. In this position the cushion will be supported above the floor or other playing surface 8 as shown in FIG. 3 and will be held in that position by the players' hands inserted in hand grips 10 in the lower edges of the loops 7, *7a*. The general relation of the players 11, 12 with respect to the cushion 1 and sling 2 is shown in stick figure style in FIG. 3.

By way of example and not of limitation, the spherical cushion 1 may have a diameter of 24 to 36 inches, the sling may have a top to bottom width of 8 inches and the maximum clearance between the loops 7, *7a* and the nearest adjacent surface of the cushion may be 4 to 8 inches. The larger clearance may result in some slack between the players and the loops and cushion. A snug fit of the players in the loops is not objectionable.

The toy may be used by the players in a variety of ways, the players may push or pull on the sling through hand grips 10 or bump the cushion. Any movement of a player toward or away from the other player (after taking up the clearance or slack if any) will result in a cushioned impact after the clearance has been taken up the cushion serves as a buffer transmitting a cushioned impact between the players while preventing direct bodily contact of the players. In addition to the bumping or impact type of games the players may dance about or one player may act as a pivot around which the other player runs or swings.

I claim:

1. A large hollow inflatable pneumatic cushion of air impervious material having a loop of wide flattened flexible material joined to opposite sides thereof, each loop having a pair of hand holds therein, each loop being of a size to receive the waist of a player, so that a pair of players each standing in a respective loop and each facing the cushion and holding the hand holds so as to confine themselves between the cushion and the loop around their back at waist height may dance about and push and pull and bump each other without direct bodily contact.

2. A large hollow inflatable pneumatic cushion of air impervious material having an inflatable pneumatic loop of flexible material joined to opposite sides thereof, each loop having a pair of hand holds therein, each loop being of a size to receive the waist of a player, so that a pair of players each standing in a respective loop and each facing the cushion and holding the hand holds so as to confine themselves between the cushion and the loop around their back at waist height may dance about and push and pull and bump each other without direct bodily contact.

* * * * *